US005269430A

United States Patent [19]

Schlaupitz et al.

[11] Patent Number: 5,269,430

[45] Date of Patent: Dec. 14, 1993

[54] INDIVIDUAL SERVING FOOD CONTAINER WITH IMPROVED HOUSING AND CLOSURE ARRANGEMENT

[75] Inventors: Robert S. Schlaupitz, Wadsworth; Patricia A. Antoni, Wheeling; Stephen A. Smith, Naperville, all of Ill.

[73] Assignee: Packaging Corporation of America, Evanston, Ill.

[21] Appl. No.: 826,895

[22] Filed: Jan. 28, 1992

[51] Int. Cl.[5] ..... B65D 6/00

[52] U.S. Cl. ..... 220/4.23; 220/306; 220/339; 206/551; 206/815; 229/2.5 R; 229/115

[58] Field of Search ..... 220/4.23, 306, 339; 206/551, 815; 229/2.5 R, 115

[56] References Cited

U.S. PATENT DOCUMENTS

| | | | |
|---|---|---|---|
| 1,848,120 | 3/1932 | Fisher | 206/551 |
| 3,620,411 | 11/1971 | Rump | 206/551 X |
| 3,710,975 | 1/1973 | Jansen | 220/339 |
| 4,244,470 | 1/1981 | Burnham | 220/4.23 X |
| 4,947,993 | 8/1990 | Bruml et al. | 206/551 |

*Primary Examiner*—Stephen P. Garbe
*Assistant Examiner*—Nova Stucker
*Attorney, Agent, or Firm*—Arnold, White & Durkee

[57] ABSTRACT

An individual serving food container is provided for housing individual servings of food products, such as pie slices and the like, which are generally triangular or wedge shaped and have an outwardly extending "crust" portion. The container includes a tray/cover combination having means for supporting the crust portions of such food product servings from collapsing when housed within the container. The rear wall of the tray has a transverse edge thereof remote from the bottom wall which extends rearwardly therefrom to define a platform adapted to support the outwardly extending crust portion of the wedge-shaped food serving contained in the housing cavity. The container is also provided with means facilitating removal of stored individual servings therefrom and guide means for facilitating proper alignment of locking elements disposed on the cover and tray so as to simplify the locking operation.

2 Claims, 3 Drawing Sheets

INDIVIDUAL SERVING FOOD CONTAINER WITH IMPROVED HOUSING AND CLOSURE ARRANGEMENT

BACKGROUND OF THE INVENTION

1. Field of the Invention

The present invention generally relates to disposable food containers and the like. More particularly, this invention relates to disposable food containers formed out of relatively transparent plastic material and particularly adapted to holding single or individual servings of food products such as cakes and pies.

2. Description of the Prior Art

Disposable containers for packaging, distributing, displaying or otherwise housing bakery goods, such as cakes, pies and the like, are becoming increasingly important in modern-day convenience food industry. The obvious desirability of means to permit visible inspection of the food product within such packages or containers has led to formation thereof of disposable see-through plastic material of different types. While a large variety of serving trays and covers are available for traditional "deli" products such as cakes, cheese, sauces, fresh vegetables and the like, a particular demand has become established in recent years for disposable see-through containers which are specifically adapted for housing single servings of products such as cakes and pies.

Such single-serving cake/pie containers are generally triangular housings which conform to the typically wedge-shaped individual portions cut out of cakes or pies. Such conventional single-serving container designs are problematic in several areas when used with pie servings. When used to house slices of freshly-baked pies, for instance, the crust thereof is commonly damaged as a result of being placed and contained within conventional pie slice containers. A primary reason for this problem is that freshly-baked pie slices have a crust which is relatively fragile and easily broken or crumbled. Consequently, conventional pie slice packages or containers are problematic in that no supporting structure is provided therein which can prevent fragile pie crust portions from collapsing within the package. Consequently, the visual appearance of the pie as well as its "quality" (from the consumer's viewpoint) is significantly damaged.

An added problem with conventional single-serving packages of the above-discussed type is that once the individual serving of the food product, particularly a pie slice or the like, has been placed inside the package, it is difficult to remove the slice from the package or container without damaging the food product contained therein. Obviously, the problem is compounded in the case of freshly-baked pie slices because of the fragile nature of the pie crust; the manipulation generally necessary to lift up the pie slice by its crust tends to affect the crust by crushing, crumbling or otherwise breaking it up. The end result, again, is that the visual appearance and "quality" of the contained food product is adversely affected.

In pie slice containers of the above-noted type, a common design feature is to provide a container in the form of separate base and lid sections which are adapted to be locked together by means of an interference fit between opposed mating sections. The problem with such a design, particularly because of the use of thin plastic material for forming the separate container sections, is the difficulty involved in correctly aligning the mating sections of the container base and the lid prior to forcing them together in an interference fit manner.

There, accordingly, exists a distinct need for a disposable single-serving container or package which is particularly adapted for housing pie slices and the like while avoiding the structural and functional disadvantages associated with conventional single-serving packages.

SUMMARY OF THE INVENTION

In view of the foregoing, it is a primary object of the present invention to provide a disposable single-serving container particularly adapted for housing pie slices without adversely affecting the outward appearance and quality of the contained product.

It is a related object of the present invention to provide such a pie slice container which is especially adapted to supporting the crust portions of a pie slice contained therein from collapsing when it is housed within the container.

A further object of the present invention is to provide such a pie slice container which is designed to permit easy and convenient removal of pie slices contained therein without damaging the crust portions thereof.

Another related object is to provide a pie slice container of the above type which is also capable of being conveniently stacked for display or storage in a stable manner.

It is also an object of the present invention to provide a pie slice container of the foregoing type which has a closure arrangement capable of convenient alignment of opposed mating elements on the tray to facilitate locking of the container.

The above and other objects are realized, in accordance with the system of the present invention, by the provision of a container adapted for housing individual servings of food products, such as pie slices and the like, which are generally triangular or wedge shaped and have an outwardly extending "crust" portion. The container comprises a tray having a generally triangular housing cavity corresponding to the shape of the food product serving to be housed therein, and a dome cover adapted to be releasably locked to the tray to effectively seal the housing cavity. According to a preferred embodiment, the container tray includes a bottom wall having a pair of sidewalls and a rear wall extending upwardly therefrom, the sidewalls diverging from an apex portion of the tray and being linked to corresponding ends of the rear wall.

In accordance with an important aspect of this invention, the rear wall of the tray has a transverse edge thereof remote from the bottom wall which extends rearwardly therefrom to define a platform adapted to support the outwardly extending crust portion of the wedge-shaped food serving contained in the housing cavity. Preferably, the width of the supporting platform is defined as being larger than the distance to which the outwardly extending crust portion of the individual food serving contained in the housing cavity extends on the platform.

According to a further feature of the present invention, the rearwardly extending support platform is made discontinuous and includes a cut-out portion having opposing sidewalls linked together by a rear wall, the sidewalls extending downwardly into contact with corresponding extending portions of the tray bottom wall to define a rearwardly extending staggered cavity which is in communication with the tray housing cavity. Preferably, the rear wall of the cut-out portion is disposed on the platform at a distance which is larger than the distance to which the crust portion of an individual food serving contained in the housing cavity extends on the platform. The staggered cavity functions as means by which an individual serving stored within the tray housing cavity may be conveniently removed without adversely affecting the stored food product. The staggered cavity also facilitates stacking of food containers of the subject type in a stable manner.

According to another aspect of the present invention, the food container includes locking means for releasably locking the container tray to its cover, and the locking elements are disposed on the tray and the cover in such a way as to be mated into forcibly displaceable mutual engagement for locking or unlocking the container. In particular, the container tray and cover combination described above is provided with guide means for facilitating proper alignment of the locking elements on the cover and tray as part of the locking operation.

According to a preferred embodiment, the alignment means includes the combination of (i) a hinge element connecting the tray and cover together about the rear walls thereof whereby the cover may be hingedly closed or opened relative to the tray, the hinge being permissive of relative lateral displacement between the cover and the tray; and (ii) guide means provided on the cover in the form of a lead-in step about the apex portion thereof, the step cooperating with a corresponding apex portion of the tray to facilitate proper positioning of the cover locking element into opposed contact with the tray locking element.

Figure 1:
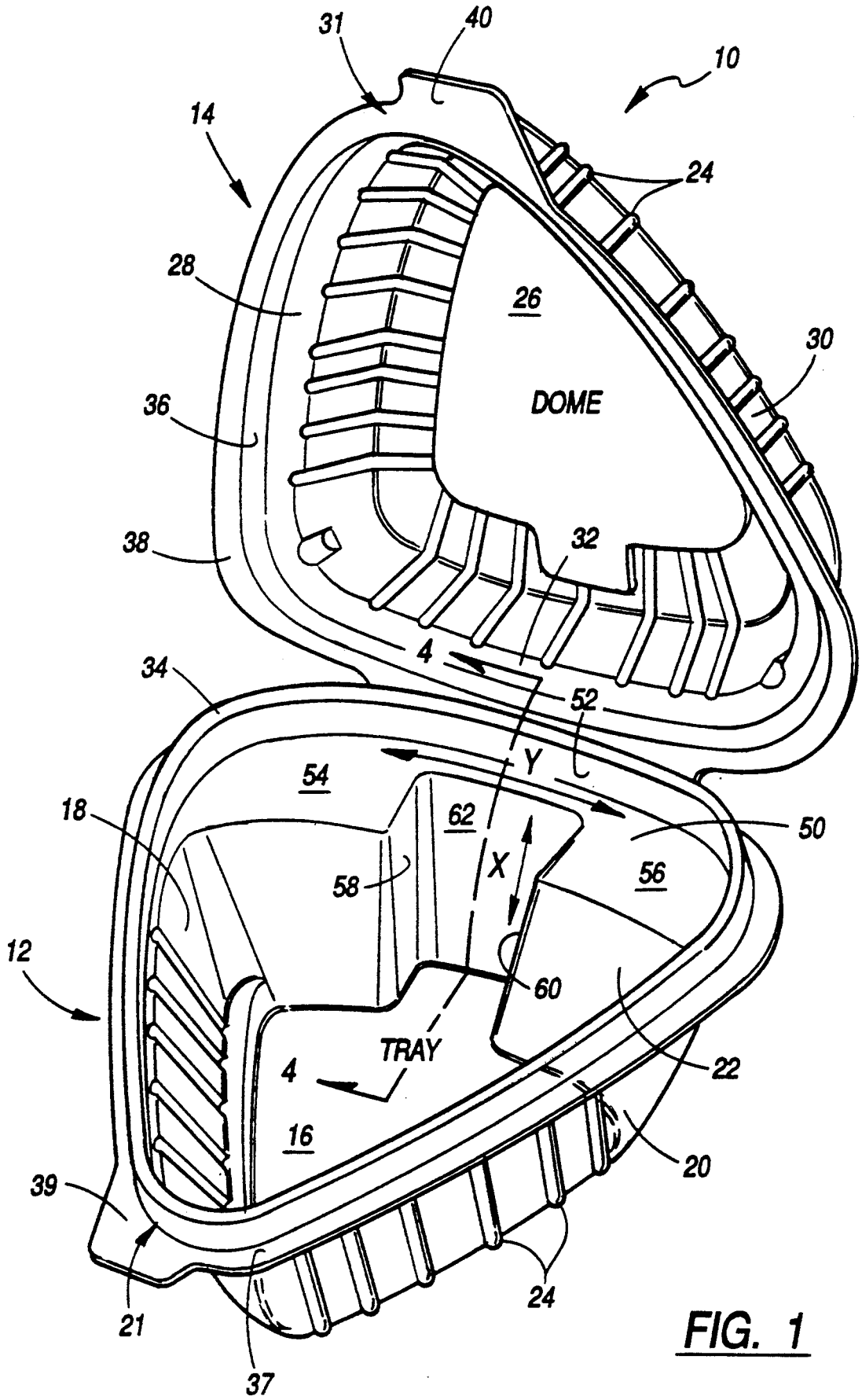
FIG. 1 is a perspective view of a pie slice container in accordance with an illustrative embodiment of the present invention, as shown in a partially open position.
Figure 2:
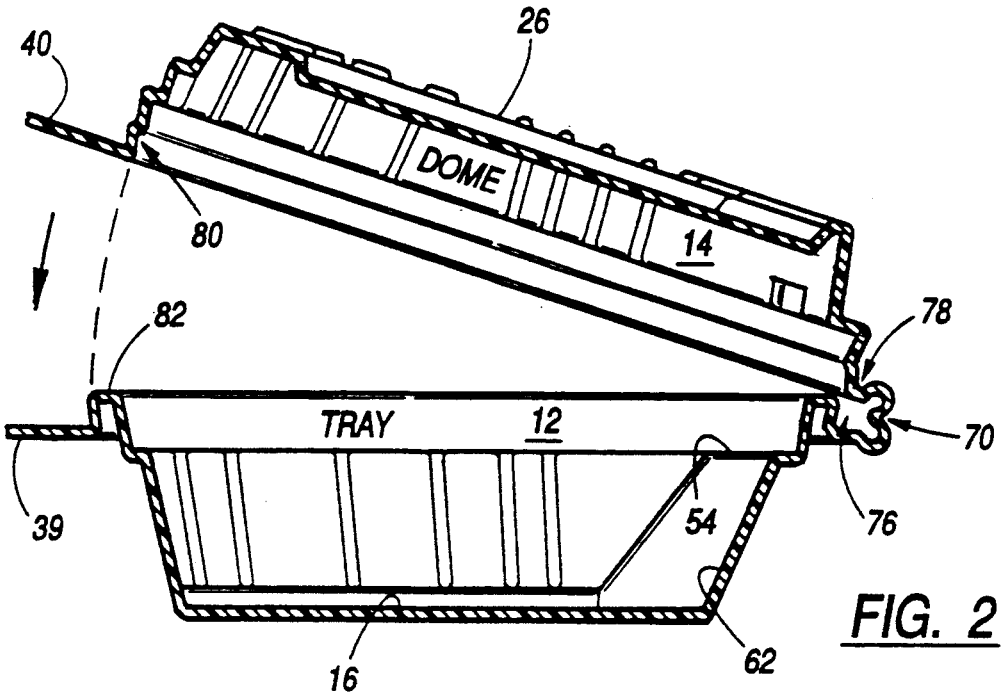
FIG. 2 is a cross-sectional view of the container shown in FIG. 1 illustrating the manner in which a supporting ledge and staggered cavity are provided to realize crust-saver means according to the system of this invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings and particularly FIG. 1, there is shown a perspective view of an individual-serving food container, more specifically, a pie slice container, shown in a partially open position, in accordance with an illustrative embodiment of the present invention. As shown therein, the container includes a tray 12 and a dome cover 14 capable of being releasably locked or otherwise attached to the tray 12 by means of appropriate locking means to be described in detail below.

The tray 12 has a generally triangular housing cavity corresponding to the generally triangular or wedge-shaped food product, particularly pie slices, to be housed therein. More specifically, the tray 12 includes a base or bottom wall 16 having a pair of side walls 18, 20 and a rear wall 22 extending upwardly therefrom. The side walls 18, 20 diverge rearwardly from an apex portion on the tray (generally indicated as 21) and are linked to corresponding ends of the rear wall 22. Generally details pertaining to the structure, design and materials for disposable plastic food containers of this type are well known to those skilled in the packaging art and, accordingly, are not discussed in detail herein. It suffices herein to state that both the tray 12 which defines the housing cavity and the dome cover 14 adapted to lock and to seal the tray 12 are formed of thin, relatively transparent plastic material and may include longitudinally extending ribs 24 for reinforcing and strengthening the structure thereof.

Referring in particular to the cover 14, the cover also has a generally triangular configuration which corresponds to that of the tray and includes a covering cavity which is defined by a top wall 26 having a pair of sidewalls 28, 30 and a rear wall 32 extending downwardly therefrom. The sidewalls 28, 30 diverge from an apex portion (generally indicated as 31) of the cover which corresponds in position and configuration to the apex portion 21 of the tray 12. The cover sidewalls 28 and 30 are linked to corresponding ends of the rear wall 26 in order to define the covering cavity.

In the illustrative embodiment shown at FIGS. 1-5, the locking means provided on the container for releasably locking the cover to the container tray includes corresponding locking elements disposed on the tray and cover which are adapted to be mated into forcibly displaceable mutual engagement in order to effectuate the locking of the cover to the tray. More specifically, the tray 12 is provided with an enclosure element or wall 34 extending upwardly from the periphery thereof including the transverse edges of the side and rear walls 16, 18, 20 remote from the bottom wall 16, and extending about the rear wall 22 of the tray. The cover 14 is provided with a corresponding enclosure wall or element 36 which similarly extends downwardly from the periphery thereof including the transverse edges of the cover side walls 28, 30 and the rear wall 32 remote from the cover top wall 26.

The specific configuration of the opposed mating elements 34 and 36 is not important for purposes of the present invention; it should, however, be noted that these elements are designed, for instance, in the form of a mating rib/groove arrangement, which accommodates an interference therebetween. In effect, the mating elements 34 and 36 are appropriately designed to realize some form of friction fit therebetween in order to effectively lock the cover 14 to the container tray 12.

As also shown in FIG. 1, both the tray 12 and the cover 14 are provided with pressure tabs 39, 40, respectively, which are disposed about the corresponding apex portions 21, 31 thereof. The tray 12 and the cover 14 are also provided with laterally extending ledges 37, 38 respectively extending about the edges of the mating elements or walls 34, 36 for ensuring effective sealing of the housing cavity. The pressure tabs 39, 40, in combination with the surrounding ledges 37 and 38, function as convenient means for assisting with exertion of the force necessary for assisting with the forcible engagement of the opposed mating elements 34, 36 in order to close and lock the container, and for assisting with the forcible disengagement of the elements in order to unlock and open the container.

According to an important aspect of the present invention, the tray 12 defining the requisite housing cavity is provided with means for adequately supporting the crust portions of a pie slice contained therein in order to prevent the crust from collapsing as and when it is housed within the container. More specifically, as best illustrated in FIG. 1, this "crust saving" function is realized by the provision of a support platform 50 which is defined by extending the transverse edge of the tray rear wall 22 which is remote from the tray bottom walls 16 rearwardly therefrom in conformity with the general shape and structure of the sidewalls 18, 20 which are linked to the rear wall 22. The platform 50 extends laterally from the transverse edge of the rear wall 22 to a predetermined width and the tray mating element 34 is defined to extend upwardly from the extreme transverse edge of the platform 50.

The arrangement is such that when an individual serving of a food product, such as a pie slice, is positioned within the tray housing cavity, the outwardly extending crust portion thereof rests on the support platform 50 and is reinforced thereby. It should be noted that the width of the support platform 50, as defined by the distance from the point where the platform is linked to the rear wall 22 to the mating element or enclosure wall 34, is defined as being larger than the distance to which the outwardly extending crust portion of the pie slice contained therein extends on the platform 50. Consequently, the pie slice or like individual serving is positioned within the tray housing cavity with the crust thereof being supported or reinforced against damage as a result of either the placement or housing operation. The arrangement is particularly effective in supporting freshly-baked pies from damage to the pie crust portions as a result of crumbling or crushing thereof.

According to a related feature of the present invention, the support platform 50 is defined as being discontinuous and includes a cut-out portion 52 which effectively divides the platform 50 into left and right platform sections 54, 56, respectively. Preferably, the cut-out portion 52 is defined by opposing sidewalls 58, 60 which are linked together by a rear wall 62 which, in effect, corresponds to a portion of the tray rear wall 22 being staggered rearwardly as a result of the definition of the cut-out portion generally indicated as 52. The sidewalls 58, 60 and the rear wall 62 of the cut-out portion 52 extend downwardly from the corresponding transverse edges of the platform 50 into contact with corresponding extending portions of the tray bottom wall 16 in order to define a rearwardly extending staggered cavity which is in communication with the tray housing cavity.

Preferably, the rear wall 62 of the cut-out portion 52 is disposed about the platform 50 at a distance, measured from the point where the platform 50 is linked to the tray rear wall 22, which is larger than the distance to which the outwardly extending crust portion of a pie slice contained within the tray housing cavity extends on the platform 50. This distance is designated as "X" in FIG. 1 and effectively defines the width of the cut-out portion 62 and the correspondingly defined staggered cavity. The arrangement is such that the width X of the cut-out portion 52 and the length thereof (designated as "Y") realize an opening on the platform 50 even when a pie slice is stored within the tray housing cavity. This opening is advantageous in that it functions as means for ingress of a finger or like instrument into the staggered cavity for convenient removal of a stored pie slice without adversely affecting the crust portion thereof.

Figure 3:
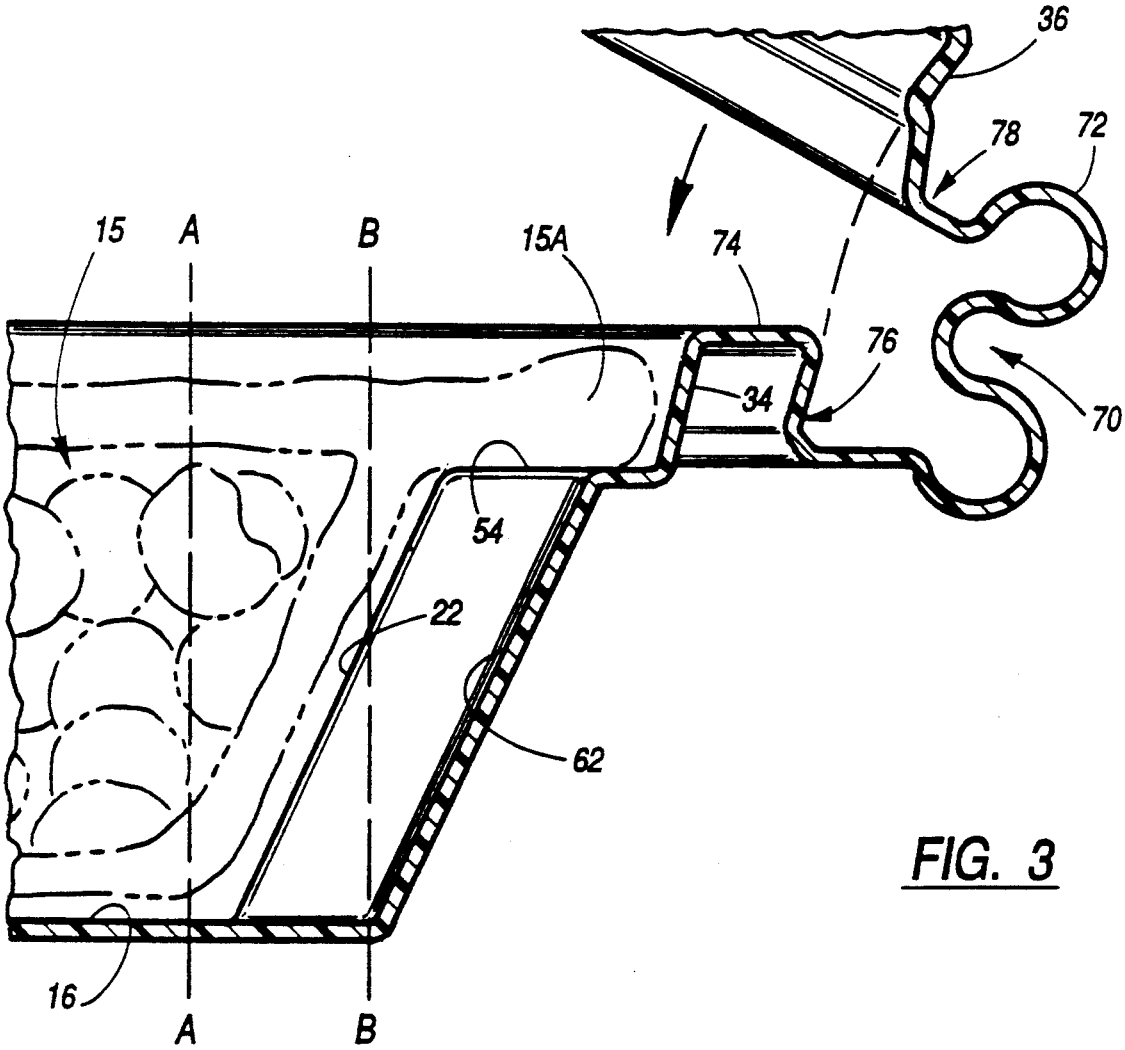
FIG. 3 is an enlarged segmented cross-sectional view taken substantially along line 4—4 in FIG. 1 and showing the relative positioning of a pie piece and the crust-saver ledge.
Figure 4:
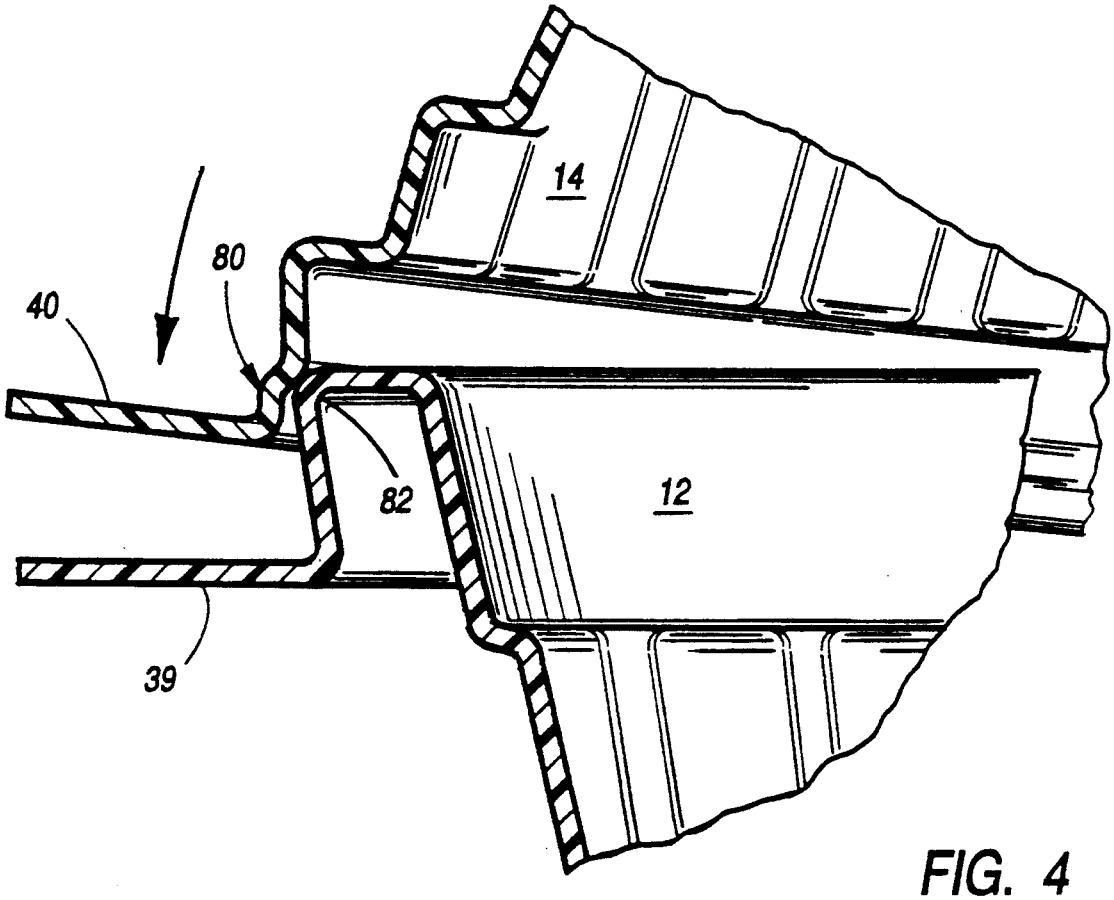
FIG. 4 is an enlarged segmented cross-sectional view illustrating the lead-in step feature, according to a feature of the present invention provided for proper alignment of the tray and cover sections of the container shown in FIGS. 1-3.
Figure 5:
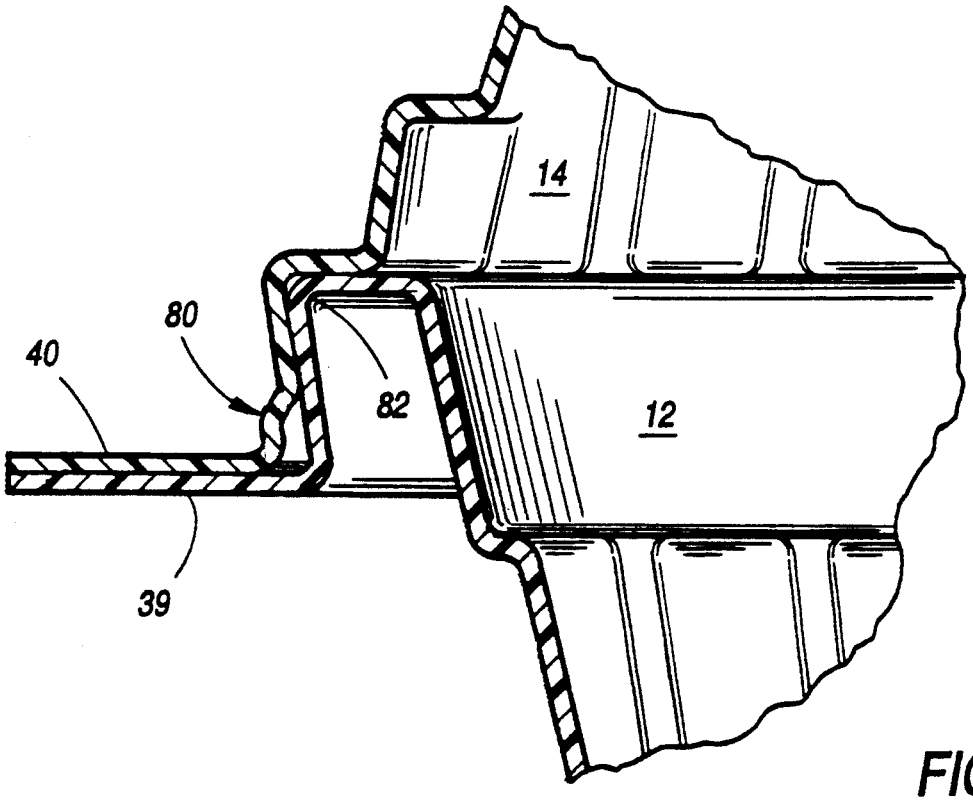
FIG. 5 is a similar enlarged segmented cross-sectional view showing the relative positioning of interlocking elements within the pie slice container of FIG. 1 as shown in its closed condition.

The staggered cavity arrangement described above is also advantageous as a means for improving the stability of a container of the above-described type when it is in a closed position with the tray housing cavity including a pie slice or like individual serving. With particular reference to FIG. 3, which is a segmented cross-sectional view of the container shown at FIG. 1 including a pie slice stored therein, the tray 16 houses a pie slice 15 disposed therein with the crust portion 15A of which is supported on the platform 50 defined by the rearward extension of the rear wall 62 of the cut-out portion 52.

In the absence of the cut-out portion 52, the relative axis of "stability" of the container is approximately defined by the vertical line A—A. It will be noted that a substantial portion of the stored pie slice extends beyond the axis A—A. However, the provision of the staggered cavity arrangement effectively shifts this axis to that represented by the vertical line B—B defined about the point at which the base or bottom wall 16 of the tray 12 is rearwardly extended into contact with the downwardly-extending rear wall 62 of the cut-out portion 52. It will be noted that only a section of the crust portion 15A of the pie slice now extends beyond the shifted axis B—B, thereby significantly improving the stability of the overall container, particularly when a plurality of such filled containers are stacked on top of each other.

In accordance with a further aspect of the present invention, an individual-serving disposable container of the general type described above is provided with an improved closure arrangement by the provision of alignment means adapted to facilitate the aligning of the container cover with the tray in order to correspondingly facilitate opposed contact between the mating locking elements provided on the tray and the cover. This aspect is as best seen in FIGS. 2–5, which are cross-sectional view showing various interacting elements of the individual-serving container according to the system of this invention.

According to an illustrative embodiment, the container tray 12 and the dome cover 14 are linked together by an integrally defined hinge element 70 which effectively connects the tray 12 and the cover 14 together about the respective rear walls 22, 32 thereof. In particular, the hinge element 70 allows the cover 14 to be hingedly closed or opened relative to the tray and is designed to be permissive of relative lateral displacement between the cover and the tray. In the preferred embodiment illustrated in the figures, the hinge element 70 has a generally "W-shaped" cross-section. Alternatively, the hinge element 70 may be selected to have other appropriate cross-sections such as "U" or "V" cross sections provided the requisite relative lateral displacement is available. As best seen in FIG. 3, the W-shaped section 72 of the hinge element 70 is connected to a horizontally extending section 74 of the tray through a generally L-shaped section 76. At its other end, the W-shaped section is connected to the cover ledge 36 by means of a generally L-shaped section 78.

In order to take advantage of the lateral displacement afforded between the cover and the tray by means of the hinge element 70, the cover 14 is provided with a lead-in step portion 80 which serves as a guide or pilot means by which the cover may be properly positioned over a corresponding laterally extending section 82 on the tray ledge 37. It should be noted that the guide means 80 and the laterally extending means 82 are both provided generally about the apex portions 31, 21 and the pressure tabs 40, 39 of the cover and tray. The arrangement is such that the opposing mating elements 34, 36 on the tray 12 and the cover 14, respectively, are placed into direct opposing contact with each other when the guide means 80 is aligned with the lateral section 82. As a result, the closing operation for the container is significantly facilitated since the cover 14 can be manipulated by taking advantage of the relative lateral displacement asserted by the hinge element 70 until the guide means 80 contacts the lateral section 82. This guided contact immediately ensures that the opposing mating elements on the tray and the cover are in proper alignment before subsequently being forced together to realize effective locking of the container.

We claim:

1. A container adapted for housing individual servings of food products having an outwardly extending "crust" portion, the container comprising:

a tray having a generally triangular housing cavity corresponding to the shape of said food product serving to be housed therein; and a dome cover adapted to be releasably locked to said tray to effectively cover said housing cavity, said tray including a bottom wall having a pair of first side walls and a pair of first rear walls extending upwardly therefrom, said first side walls diverging from an apex portion of said tray and being linked to corresponding ends of said first rear walls, said first rear walls having a transverse edge which is remote and extending rearwardly from said bottom wall to define a discontinuous platform adapted to support said outwardly extending crust portion of said food product contained in said housing cavity, wherein said platform has a width larger than a distance to which said outwardly extending crust portion of said individual food serving, if contained therein, would extend on said platform, and said container includes a cut-out portion including opposing second side walls linked together by a second rear wall, said second side walls and said second rear wall extending downwardly from said platform into contact with a corresponding extending portion of said bottom wall of said tray to define a rearwardly extending staggered cavity in communication with said tray housing cavity.

2. The individual serving food container as set forth in claim 1 wherein said second rear wall of said cutout portion is linked to said platform at a distance from a point where said platform is linked to said first rear wall, which is larger than a distance to which said outwardly extending crust portion of said individual food serving, if contained therein, would extend on said platform.

* * * * *